US010483686B2

(12) United States Patent
Tang

(10) Patent No.: US 10,483,686 B2
(45) Date of Patent: Nov. 19, 2019

(54) HIGH-SAFETY POWER STRIP

(71) Applicant: Shenzhen HUYUAN Electric Technology Co., Ltd., Shenzhen, Guangdong (CN)

(72) Inventor: Jinlong Tang, Guangdong (CN)

(73) Assignee: Shenzhen HUYUAN Electric Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/059,021

(22) Filed: Aug. 8, 2018

(65) Prior Publication Data

US 2019/0067870 A1 Feb. 28, 2019

(30) Foreign Application Priority Data

Aug. 25, 2017 (CN) ..... 2017 1 0741069

(51) Int. Cl.

| | |
|---|---|
| ***H01R 13/62*** | (2006.01) |
| ***H01R 13/52*** | (2006.01) |
| *H01R 25/00* | (2006.01) |
| *H01R 103/00* | (2006.01) |
| *H01R 27/02* | (2006.01) |
| *H01R 13/639* | (2006.01) |

(52) U.S. Cl.
CPC ..... *H01R 13/5213* (2013.01); *H01R 13/6395* (2013.01); *H01R 25/003* (2013.01); *H01R 27/02* (2013.01); *H01R 2103/00* (2013.01)

(58) Field of Classification Search
CPC .... H01R 13/72; H01R 13/665; H01R 13/652; H01R 13/6666; H01R 13/5213; H01R 13/5833; H01R 27/02; H01R 2013/00; H01R 13/6395
USPC ..... 439/367
See application file for complete search history.

(56) References Cited

U.S. PATENT DOCUMENTS

| | | | | |
|---|---|---|---|---|
| 7,238,028 | B2 * | 7/2007 | Gerard | H01R 13/652 439/188 |
| 7,688,564 | B2 * | 3/2010 | Byrne | H01R 13/6666 361/111 |
| 7,753,682 | B2 * | 7/2010 | Gerard | H01R 13/652 439/13 |
| 8,193,658 | B2 * | 6/2012 | Fleisig | H01R 13/665 174/493 |
| 8,217,528 | B2 * | 7/2012 | Fleisig | H01R 13/72 174/493 |

* cited by examiner

*Primary Examiner* — Jean F Duverne

(57) ABSTRACT

The present invention discloses a high-safety power strip comprising a power strip body, having a plurality of three-hole and/or two-hole jacks for connecting with at least one plug; and a protective housing having an opening at one side thereof, the protective housing being connected with the power strip body, the jacks are located in the protective housing and face an inner wall of the protective housing. As the power strip of the invention comprises a protective housing, and the protective housing is covered outside the power strip body to prevent water or other liquid from splashing into the jacks of the power strip body, thus avoiding water or other liquid entering into the interior of the power strip body through the jacks. Therefore, the power strip of the invention has relatively high safety.

18 Claims, 9 Drawing Sheets

HIGH-SAFETY POWER STRIP

CROSS REFERENCE TO RELATED APPLICATIONS

The present application claims the benefit of Chinese Patent Application No. 201710741069.3 filed on Aug. 25, 2017. All the above are hereby incorporated by reference.

TECHNICAL FIELD

The present invention relates to a power strip, and particularly to a high-safety power strip.

BACKGROUND

Generally, the jacks (namely, the position for plug connection, usually refer to a three-hole and/or two-hole jack) of the typical power strips are exposed. During use, external substances such as water or other liquid are easy to get into the interior of the power strip through the jack, resulting in short circuit of the power strip. Accordingly, the service safety of the typical power strips are comparatively poor.

SUMMARY

Specific to the disadvantages of the prior art, the purpose of the invention is to provide a high-safety power strip to effectively prevent external substances from entering into the interior of the power strip, thus improving the service safety of the power strip.

To solve the above technical problem, the technical solution taken in this invention is as follows:

A high-safety power strip is provided, comprising a power strip body, having a plurality of three-hole and/or two-hole jacks for connecting with at least one plug; and a protective housing having an opening at one side thereof, the protective housing being connected with the power strip body, the jacks are located in the protective housing and face an inner wall of the protective housing.

Furthermore, the power strip body is entirely accommodated in the protective housing.

Furthermore, the protective housing is in a shape of cuboid with a cavity for receiving the power strip, and the power strip body is in a shape of cuboid.

Furthermore, each of the jacks has a profile in a shape of square, round or oval.

Furthermore, the power strip body is parallel to the protective housing in a lengthwise direction, and the jacks are linearly distributed along the lengthwise direction of the power strip body.

Furthermore, each of the jacks has a profile in a shape of square, and one pair of opposite sides of each jack is parallel to a long side of the power strip body.

Furthermore, each of the jacks has a profile in a shape of square, and an acute angle is formed between one pair of opposite sides of each jack and a long side of the power strip body.

Furthermore, the protective housing is connected to the power strip body by at least one joint structure.

Furthermore, each of the at least one joint structure comprises a clamping bar arranged on an inner wall of the protective housing, and a slot provided on the power strip body, and the clamping bar is engagable with the slot by means of inserting.

Furthermore, a plurality of wire-passing gaps are defined on the protective housing, each two adjacent wire-passing gaps are separated by a block part, and the wire-passing gaps are in communication with the opening of the protective housing.

Furthermore, the protective housing is integrally provided with a plurality of tabs, the tabs are respectively corresponding to the wire-passing gaps, and each of the tabs extends from one block part arranged on one side of the wire-passing gap towards another side of the wire-passing gap and terminates at a central portion of the wire-passing gap.

Furthermore, the power strip further comprising a plurality of wrapping posts arranged on an inner wall of the protective housing or on surfaces of the power strip body.

Furthermore, the wrapping posts extend towards the opening of the protective housing from the power strip body.

Furthermore, a plurality of loose-proof outer edges are formed at free ends of the wrapping posts respectively, and the loose-proof outer edges extend from an outer wall of the wrapping post in a direction transverse to the wrapping posts.

Furthermore, the wire-passing gaps are arranged respectively corresponding to the jacks, and the jacks are arranged corresponding to the wrapping posts respectively.

Furthermore, the protective housing is in a shape of cylinder with the opening on one end thereof, the power strip body is in a shape of prismoid, and the jacks are distributed circumferentially on a sidewall of the power strip body, an annular space is formed between the sidewall of the power strip body and the inner wall of the protective housing for receiving the at lease one plug.

Furthermore, the power strip body comprises a bottom wall connecting with a bottom circumference of the sidewall, an opening is defined in the bottom wall and a power jack is arranged at the opening of the bottom wall.

Furthermore, the protective housing is in a shape of cylinder with the opening on one end thereof, and the power strip body is attached to the inner wall of the protective housing, the power strip body defines a space at a central portion thereof for receiving the at least one plug.

Furthermore, a sidewall of the power strip body is in a shape of prismoid, and the jacks are distributed circumferentially on the sidewall of the power strip body, the power strip body further comprises a bottom flange extending radially outwardly from a bottom circumference of the sidewall to the inner wall of the protective housing.

Furthermore, the bottom flange defines an opening therein and a power jack is arranged at the opening of the bottom flange.

Compared with the traditional power strip, the beneficial effects of the invention are as follows:

As the power strip of the invention comprises a protective housing, and the protective housing is covered outside the power strip body to prevent water or other liquid from splashing into the jacks of the power strip body, thus avoiding water or other liquid entering into the interior of the power strip body through the jacks, and improving the service safety of the power strip effectively.

Figure 1:
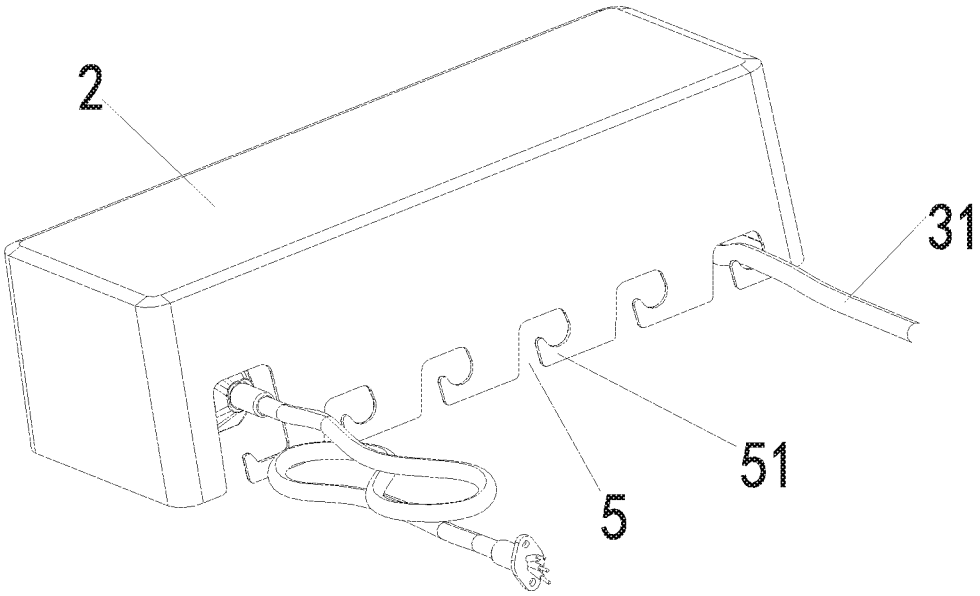
FIG. 1 is an external view of a high-safety power strip shown in the embodiment I of the invention.

Reference numerals in the drawings are as follows: power strip body 1, bottom wall 1*a*, top wall 1*a*', sidewall 1*b*, annular flange 1*c*, slot 11, protective housing 2, round cover 2*a*, annular side wall 2*b*, mounting base 20, clamping bar 21, wire 31, plug 32, jack 4, insulating cover 40, ground copper plate 43, ground terminal 430, neutral copper plate 42, neutral terminal 420, live copper plate 41, live terminal 410, power jack 44, opening 46, wire-passing gap 5, block part 50, tab 51, wrapping post 6, loose-proof outer edge 61.

DESCRIPTION OF THE EMBODIMENTS

Combined with detailed embodiments, the invention is further specified below.

Embodiment I

Figure 2:
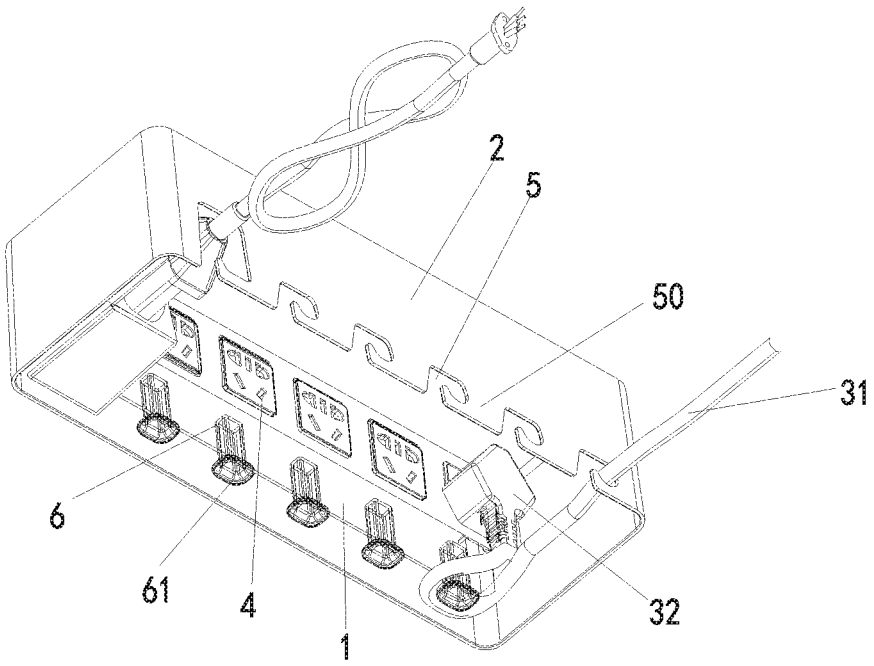
FIG. 2 is a view of the power strip shown in the embodiment I of the invention from another angle.

As shown in FIG. 1 and FIG. 2, a high-safety power strip comprises a power strip body 1 and a protective housing 2, and the protective housing 2 is connected with the power strip body 1. The power strip body 1 is provided with a plurality of three-hole and/or two-hole jacks 4 configured for connecting plugs 32, and each of the jacks 4 in this embodiment is a combination of the three-hole and two-hole jacks. An opening is set at one side of the protective housing 2, allowing for placing the plug 32 into the protective housing 2 or taking the plug 32 out therefrom. The jacks 4 are located in the protective housing 2 and towards the inner wall of the protective housing 2. Preferably, the power strip body 1 is further entirely accommodated in the protective housing 2. The jacks 4 of the embodiment are located in the protective housing 2 to prevent water or other liquid from splashing into the jacks 4 of the power strip body 1, thus avoiding water or other liquid entering into the interior of the power strip body 1 through the jacks 4. Therefore, the power strip has comparatively high service safety.

Preferably, as shown in FIG. 2, the power strip body 1 is in a shape of cuboid and the protective housing 2 is in a shape of cuboid with a cavity for receiving the power strip body 1. In the embodiment, the length of the power strip body 1 is slightly smaller than the length of the protective housing 2, the width of the power strip body 1 is less than the width of the protective housing 2, the height of the power strip body 1 is smaller than the height of the protective housing 2, which reserves enough space between the power strip body 1 and protective housing 2 for receiving the plug 32. The jack 4 may have a profile in a shape of square, round, oval or any other shape. In the embodiment, five square jacks 4 are evenly and linearly distributed along a length direction of the power strip body 1. Preferably, one pair of opposite sides of each jack 4 is parallel to the long side of the power strip body 1. A power jack 44 is provided on an end part of the power strip body 1 for connecting to a power supply.

Figure 3:
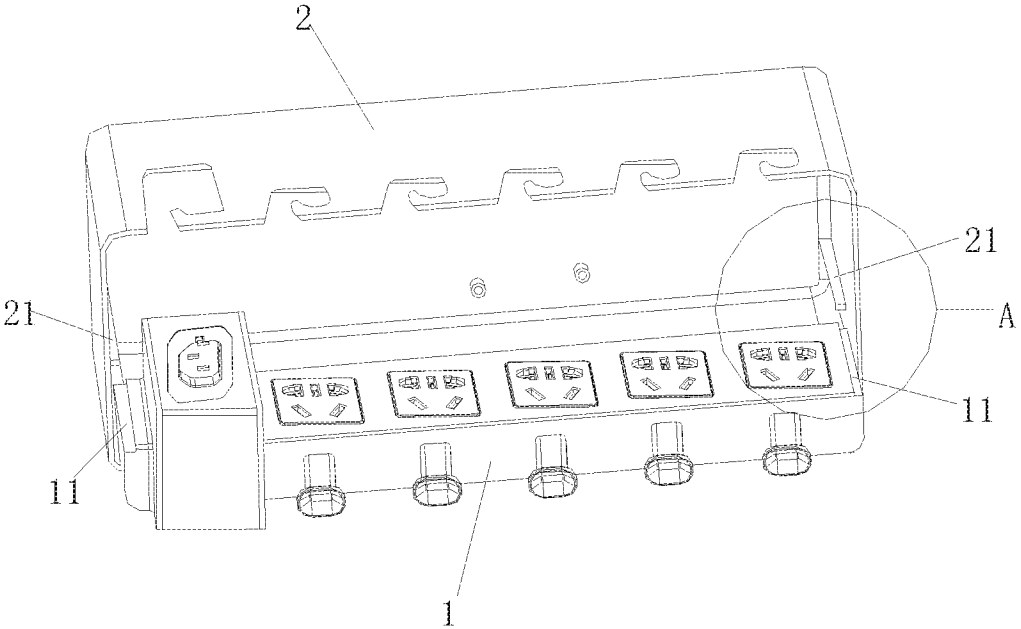
FIG. 3 is a view of the power strip shown in the embodiment I of the invention from another angle, in which the power strip body is separated from the protective housing.
Figure 4:
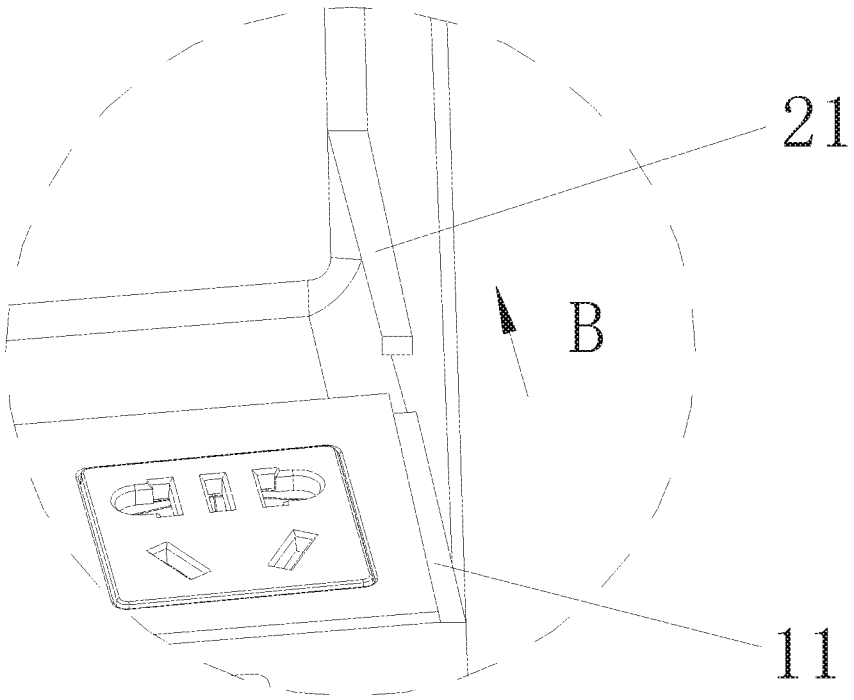
FIG. 4 is a partial enlarged view of the portion A shown in FIG. 3.

As shown in FIG. 3 and FIG. 4, assembling of the protective housing 2 and power strip body 1 is implemented by joint structures. The joint structure includes a clamping bar 21 arranged on the inner wall of the protective housing 2 and a slot 11 (alternatively, gap or other structures) provided on the power strip body 1 for insertable matching with the clamping bar 21. In the embodiment, both ends of the power strip body 1 are respectively provided with a slot 11, accordingly, the protective housing 2 is also provided with two clamping bars 21 opposite to each other.

Align the slots 11 at both ends of the power strip body 1 with the respective clamping bars matched therewith, then push the power strip body 1 into the protective housing 2 along the direction B shown in FIG. 4, thus achieve the joint between the clamping bar 21 and slot 11. When the clamping bar 21 fits with the slot 11, the power strip body 1 is clamped by the two opposite inner side walls of the protective housing 2. The joint structure of clamping bar 21 and slot 11 makes the assembling of the protective housing 2 and power strip body 1 convenient, thus achieving higher assembly efficiency in the production process of the power strip.

Preferably, a plurality of wire-passing gaps 5 are defined on the protective housing 2, and each two adjacent wire-passing gaps 5 are separated by a block part 50. The wire-passing gap 5 is in communication with the opening of the protective housing 2. Specifically, the wire-passing gap 5 is located at the bottom edge of the protective housing 2 for allowing the wire 31 of the plug 32 to pass through. In the embodiment, the protective housing 2 is provided with five wire-passing gaps 5, arranged corresponding to the five jacks 4 respectively. Preferably, the distance between the wire-passing gap 5 and the top of the power strip body 1 is larger than the distance between the corresponding jack 4 and the top of the power strip body 1, which effectively prevents water and other external substances from splashing into the jacks 4, thus further improving the service safety of the power strip.

Preferably, the protective housing 2 is integrally provided with a plurality of tabs 51 (as shown in FIG. 1), and the tabs 51 are respectively corresponding to the wire-passing gaps 5. Moreover, the tabs 51 extend from the block part 50 on one side of the wire-passing gap 5 towards the other side of the wire-passing gap 5 and terminates at the center of the wire passing gap 5. Such type of tab 51 can support the wire 31 of the plug 32 and somewhat limit the movement of wire 31, keeping the relative stability between the wire 31 and protective housing 2 as much as possible.

Preferably, a plurality of wrapping posts 6 configured for winding the wires 31 of the plugs 32 can be mounted on the inner walls of the protective housing 2 or on the surfaces of the power strip body 1. As shown in FIG. 2, in the embodiment, the power strip body 1 is provided with five wrapping posts 6, matching with the wrapping posts 6, respectively. The five wrapping posts 6 extend towards the opening of the protective housing 2 from the power strip body 1. Winding the wire 31 around the wrapping post 6 and making the wire 31 pass through the wire-passing gap 5 and protective housing 2 successively enables the wire 31 nearby the wrapping post 6 to form a circuitous course, thus playing a buffer function. In this way, even in case that a portion of the wire 31 extending out of the protective housing 2 is impacted or dragged, the plug 32 connected with the jack 4 would not be suffered from impact too much to loose, such that the connection stability of the plug 32 and the jack 4 is ensured. Meanwhile, the wrapping post 6 can be further used to support redundant part of the wire 31 in the protective housing 2 by winding the redundant part of the wire 31 around the wrapping post 6, which not only adjusts the length of the outgoing line based on various requirement for the length, but also makes full use of the internal space of the protective housing 2, avoiding the exposure of redundant wire 31, thus the power strip plugged with the plug 32 has a more concise and beautiful appearance.

Preferably, a loose-proof outer edge 61 is formed on a free end of the wrapping post 6 and extends from an outer wall of the wrapping post 6 in the direction transverse to the wrapping post 6. In the embodiment, the loose-proof outer edge 61 is circumferentially provided on the side wall of the wrapping post 6. The loose-proof outer edge 61 can be used to prevent the wire 31 from detaching from the wrapping post 6, further improving the connection stability of the plug 32.

Figure 5:
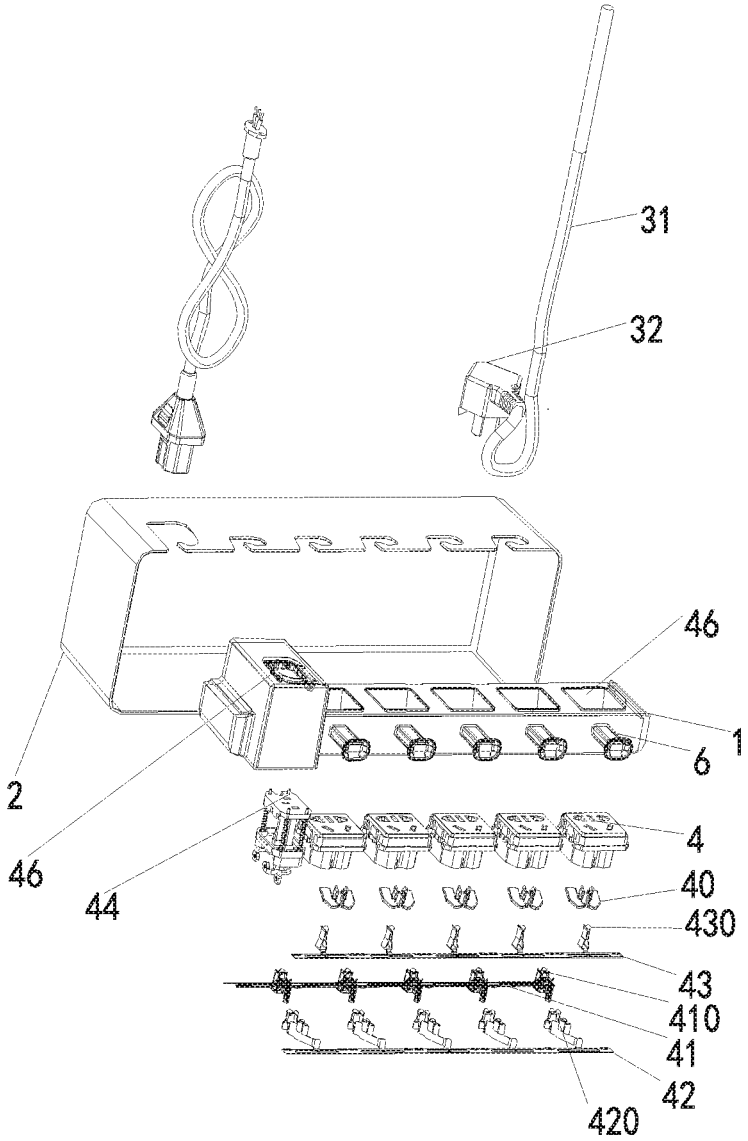
FIG. 5 is an exploded schematic view of the power strip shown in the embodiment I of the invention.

As shown in the FIG. 5, it is an exploded schematic view of the power strip in the embodiment I. The power strip body 1 defines a plurality of openings 46 corresponding to the jacks 4 and the power jack 44. Each jack 4 is provided with an insulating cover 40 at one side of the jack 4 opposite to the holes. A ground copper plate 43, a neutral copper plate 42 and a live copper plate 41 are arranged insulated from each other, on the insulating covers 40 at sides far away from the jacks 4. The ground copper plate 43, neutral copper plate 42 and live copper plate 41 each are substantially in the shape of strip and arranged on the side surfaces of the insulating covers 40 side by side. Preferably, the ground copper plate 43, neutral copper plate 42 and live copper plate 41 each define a plurality of mounting holes. The inner side wall of the power strip body 1 is formed with mounting columns corresponding to mounting holes. Specifically, the mounting columns are arranged at the inner side wall where the openings 46 locate. By engagement of the mounting columns and the mounting holes, the ground copper plate 43, neutral copper plate 42 and live copper plate 41 are fixedly mounted in the interior of the power strip body 1, and thus the jacks 4 are also fixedly mounted in the power strip body 1. In the embodiment, the ground copper plate 43 forms a plurality of ground terminals 430, the neutral copper plate 42 forms a plurality of neutral terminal 420 and the live copper plate 41 forms a plurality of live terminal 410. Each of the terminals is plugged into the jack 4. When the plug 32 is plugged into one of the jack 4, the ground terminals 430 achieve the electric connection between the ground copper plate 43 and the ground wire connected with the plug 32, the neutral terminals 420 achieve the electric connection between the neutral copper plate 42 and the null line connected with the plug 32, and the live terminals 410 achieve the electric connection between the live copper plate 41 and the live wire connected with the plug 32.

Figure 6:
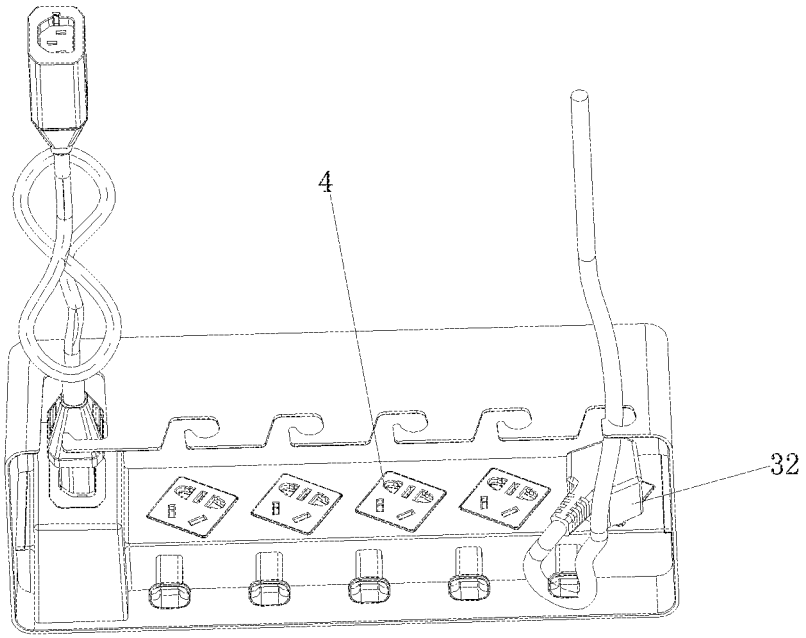
FIG. 6 is a schematic view of the power strip shown in the alternative solution of the embodiment I of the invention.

As an alternative solution, shown in FIG. 6, an acute angle is formed between one pair of opposite sides of each jack 4 and the long side of the power strip body 1, namely, the jacks 4 are arranged slantwise so that the plug 32 plugged in the jack is arranged slantwise, thus making the power strip capable of receiving a larger plug 32.

Embodiment II

Figure 7:
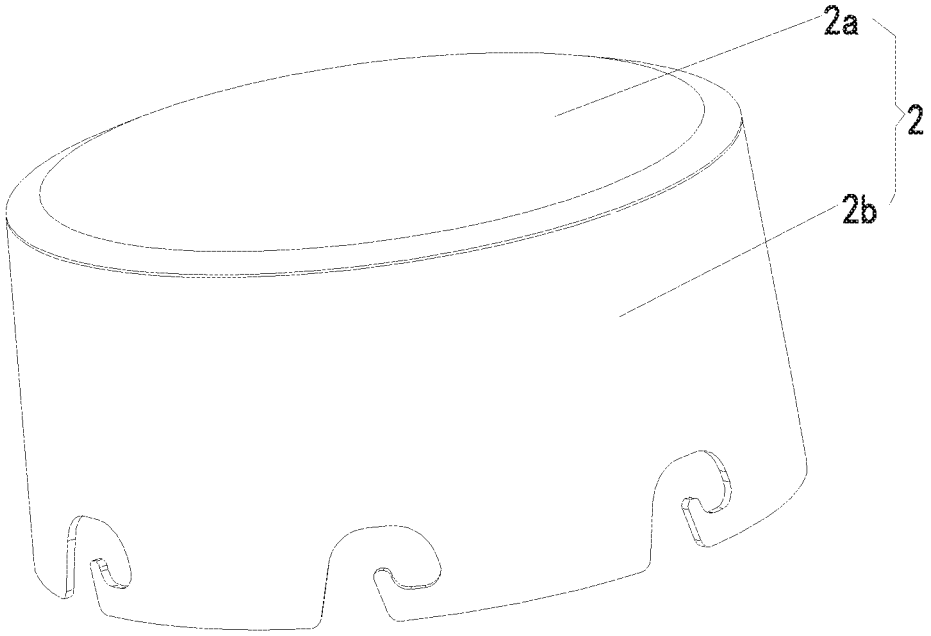
FIG. 7 is an external view of the power strip shown in the embodiment II of the invention.
Figure 8:
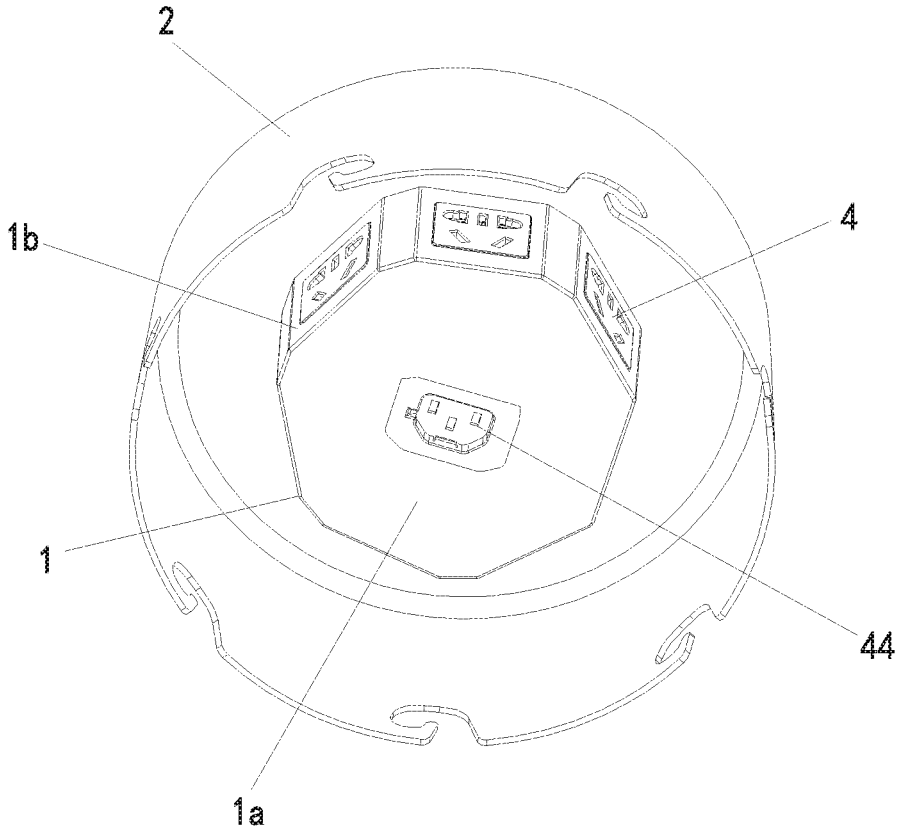
FIG. 8 is a view of the power strip shown in the embodiment II of the invention from another angle.
Figure 9:
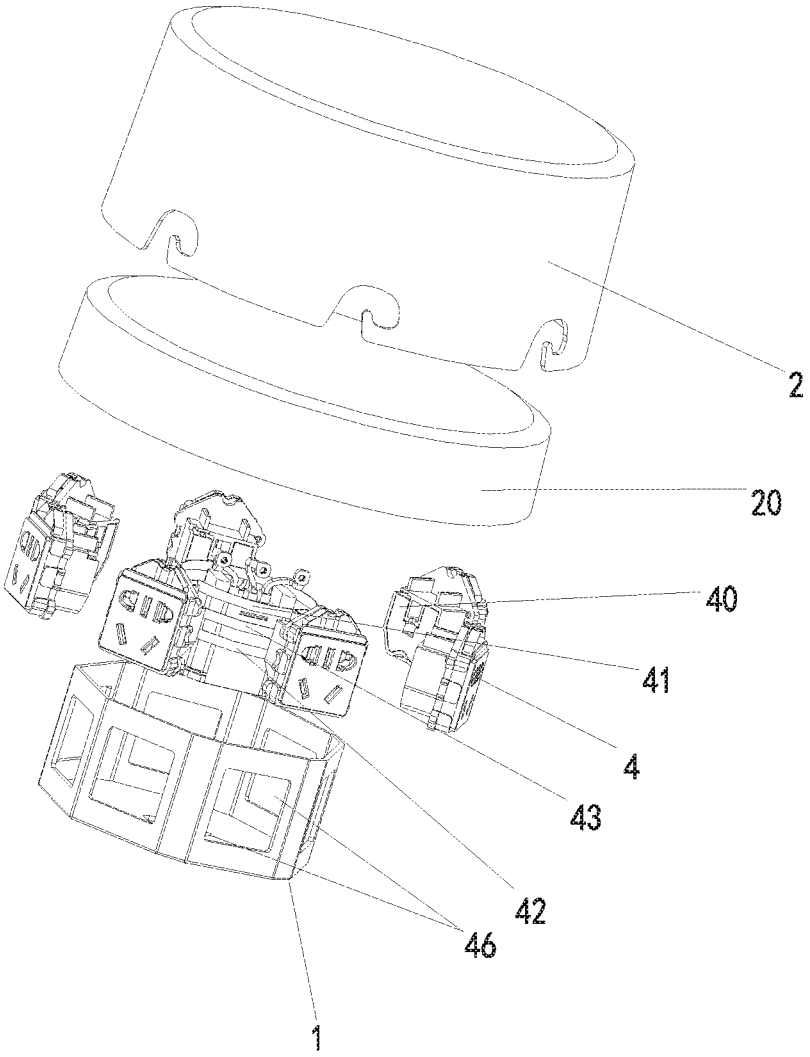
FIG. 9 is an exploded schematic view of the power strip shown in the embodiment II of the invention.

Referring to FIG. 7, FIG. 8 and FIG. 9, a second embodiment is shown which differs from the first embodiment in that, the protective housing 2 in this embodiment is in a shape of cylinder, and the power strip body 1 is substantially in the shape of prismoid. Specifically, the protective housing 2 comprises a round cover 2*a* and an annular side wall 2*b*, with one end of the annular side wall 2*b* connected with a circumference of the round cover 2*a*. The power strip body 1 includes a polygon bottom wall 1*a* and a sidewall 1*b* extending from a periphery of the bottom wall 1*a*. The power strip body 1 is arranged on an inner side of the round cover 2*a* with the bottom wall 1*a* away from the round cover 2*a* and the jacks 4 opposite to an inner surface of the annular side wall 2*b*. An annular space is formed between the sidewall 1*b* of the power strip body 1 and the inner side of the annular side wall 2*b* of the protective housing 2 for receiving the plug. Preferably, a mounting base 20 is provided in the protective housing 2 and fixed on the inner side of the round cover 2*a*, accordingly, the power strip body 1 is mounted on the mounting base 20, which may further improve the durability of the power strip. A plurality of openings 46 are defined on the sidewall 1*b* of the power strip body 1 and one opening is defined at a central portion of the bottom wall 1*a*. The jacks 4 are arranged at the openings 46 on the sidewall 1*b* of the power strip body 1 accordingly, and the power jack 44 is arranged at the opening 46 at the bottom wall 1*a* of the power strip body 1. Each jack 4 and the inner surface of the annular side wall 2*b* of the protective housing 2 define a space there between for receiving plug. The jacks 4 are circumferentially and evenly distributed on the sidewall 1*b* of the power strip body 1, and the insulating covers 40 are respectively arranged at one side of the jacks 4 opposite to the holes and collectively distributed circumferentially in the interior of the power strip body 1. Each of the ground copper plate 43, the neutral copper plate 42 and the live copper plate 41 is substantially in the shape of annular and arranged on one side of the insulating covers 40. The diameters of the copper plates are substantially the same, and the power jack 44 is arranged at the center of the collective jacks 4. The power strip in this embodiment has a cylindrical profile and thus achieves a more compact structure, and thereby saving space.

Embodiment III

Figure 10:
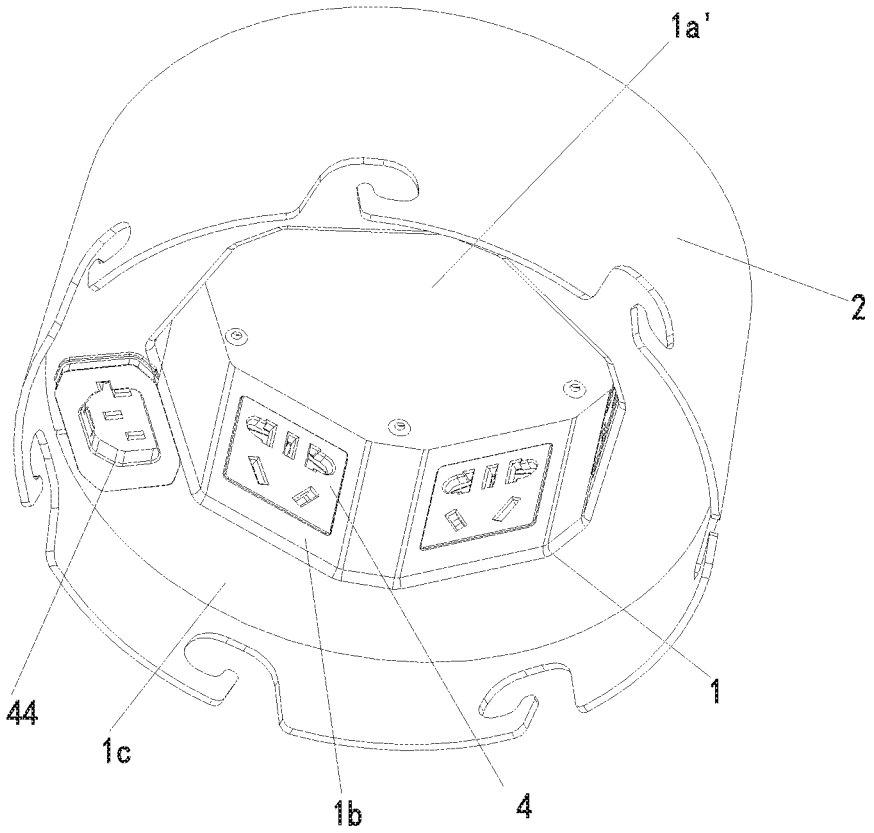
FIG. 10 is a schematic view of the power strip shown in the embodiment III of the invention.
Figure 11:
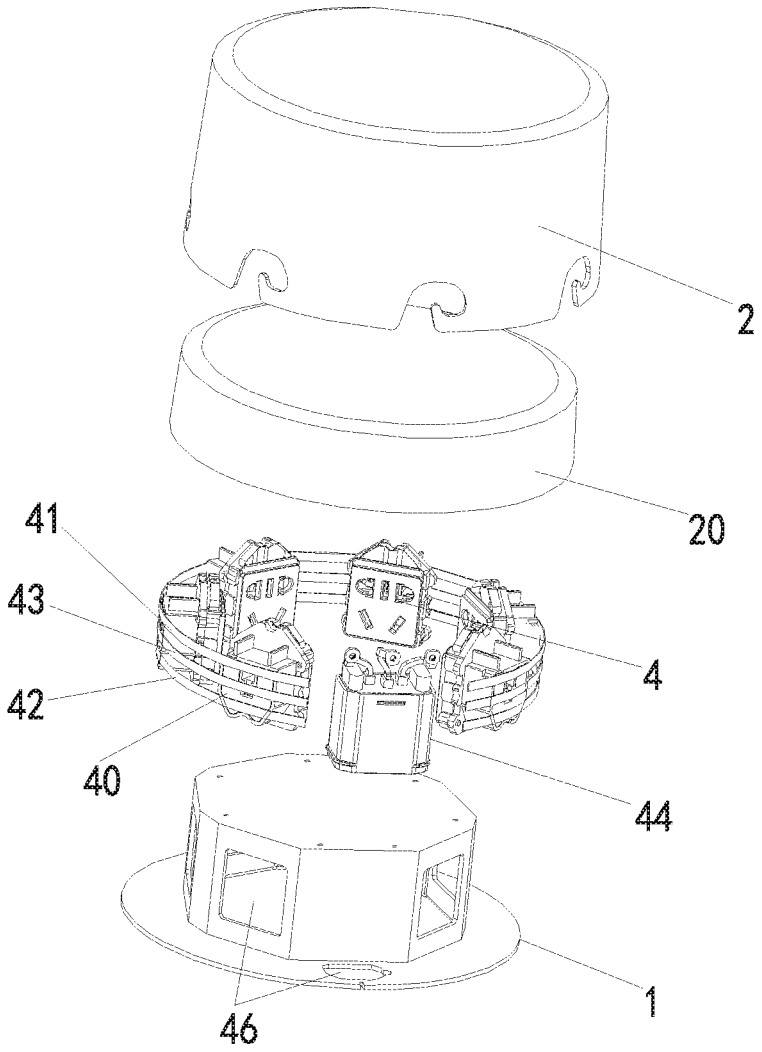
FIG. 11 is an exploded schematic view of the power strip shown in the embodiment III of the invention.

Referring to FIG. 10 and FIG. 11, a third embodiment is shown, which differs from the first embodiment in that, the protective housing 2 in this embodiment is in a shape of cylinder. Specifically, the protective housing 2 comprises a round cover 2*a* and an annular side wall 2*b*, with one end of the annular side wall 2*b* connected with a circumference of the round cover 2*a*. Further, the power strip body 1 includes a polygon top wall 1*a*' and a sidewall 1*b* extending from a periphery of the top wall 1*a*'. The power strip body 1 is arranged on an inner side of the round cover 2*a* with the top wall 1*a*' adjacent to the round cover 2*a* and the jacks 4 facing a central axis of the annular side wall 2*b*. The top wall 1*a*' and the sidewall 1*b* of the power strip body 1 cooperative define a space at a central portion of the power strip body 1 for receiving plugs. Further, an annular flange 1*c* is formed at a bottom of the power strip body 1, extending from a bottom of the sidewall 1*b* radially and outwardly terminating at the inner wall of the protective housing 2. A plurality of openings 46 are defined on the sidewall 1*b* of the power strip body 1 and one opening is defined at the annular flange 1*c*. The jacks 4 are arranged at the opening 46 on the sidewall 1*b* of the power strip body 1, and the power jack 44 is accordingly arranged at the opening 46 at the annular flange 1*c* of the power strip body 1. Preferably, a mounting base 20 is arranged on the inside of the round cover 2*a*, accordingly, the power strip body 1 is mounted on the mounting base 20, which may further improve the durability of the power strip.

Preferably, the sidewall 1*b* of the power strip body 1 is in a shape of prismoid, the jacks 4 are circumferentially and evenly distributed on the sidewall 1*b* of the power strip body 1. The insulating covers 40 are respectively arranged at one side of the jacks opposite to the holes and collectively distributed circumferentially in the interior of the power strip body 1. Each of the ground copper plate 43, the neutral copper plate 42 and the live copper plate 41 is substantially in the shape of annular and arranged on one side of the insulating covers 40, the diameter of copper plates are substantially the same. The power strip in this embodiment has a cylindrical profile and thus achieves a more compact structure, and thereby saving space.

It should be understood that the drawings described herein are only used for demonstrative description and merely provided for illustrating instead of pictures of commercial products and limiting the present invention. To specify the embodiments of the invention better, some parts of the drawings will be omitted, zoomed in or out to some extent, therefore, the size of the real products cannot be represented. For the skilled person of this field, it is understandable to omit some common structures and descriptions in the drawings possibly.

What is disclosed above is merely a comparatively optimum embodiment instead of limiting the scope of claims in the invention. Therefore, the equivalent changes made on the basis of the claims in this invention are still subject to the scope of the invention.

What is claimed is:

1. A high-safety power strip comprising:

a power strip body, having a plurality of three-hole and/or two-hole jacks for connecting with at least one plug; and a protective housing having an opening at one side thereof, the protective housing being connected with the power strip body, wherein the jacks are located in the protective housing and face an inner wall of the protective housing;

wherein the protective housing is connected to the power strip body by at least one joint structure;

wherein each of the at least one joint structure comprises a clamping bar arranged on an inner wall of the protective housing, and a slot provided on the power strip body, and the clamping bar is engagable with the slot by means of inserting.

2. The power strip according to claim 1, wherein the power strip body is entirely accommodated in the protective housing.

3. The power strip according to claim 2, wherein the protective housing is in a shape of cuboid with a cavity for receiving the power strip, and the power strip body is in a shape of cuboid.

4. The power strip according to claim 3, wherein each of the jacks has a profile in a shape of square, round or oval.

5. The power strip according to claim 3, wherein the power strip body is parallel to the protective housing in a lengthwise direction, and the jacks are linearly distributed along the lengthwise direction of the power strip body.

6. The power strip according to claim 5, wherein each of the jacks has a profile in a shape of square, and one pair of opposite sides of each jack is parallel to a long side of the power strip body.

7. The power strip according to claim 5, wherein each of the jacks has a profile in a shape of square, and an acute angle is formed between one pair of opposite sides of each jack and a long side of the power strip body.

8. A high-safety power strip comprising:

a power strip body, having a plurality of three-hole and/or two-hole jacks for connecting with at least one plug; and a protective housing having an opening at one side thereof, the protective housing being connected with the power strip body, wherein the jacks are located in the protective housing and face an inner wall of the protective housing;

wherein a plurality of wire-passing gaps are defined on the protective housing, each two adjacent wire-passing gaps are separated by a block part, and the wire-passing gaps are in communication with the opening of the protective housing.

9. The power strip according to claim 8, wherein the protective housing is integrally provided with a plurality of tabs, the tabs are respectively corresponding to the wire-passing gaps, and each of the tabs extends from one block part arranged on one side of the wire-passing gap towards another side of the wire-passing gap and terminates at a central portion of the wire-passing gap.

10. The power strip according to claim 8, further comprising a plurality of wrapping posts arranged on an inner wall of the protective housing or on surfaces of the power strip body.

11. The power strip according to claim 10, wherein the wrapping posts extend towards the opening of the protective housing from the power strip body.

12. The power strip according to claim 10, wherein a plurality of loose-proof outer edges are formed at free ends of the wrapping posts respectively, and the loose-proof outer edges extend from an outer wall of the wrapping post in a direction transverse to the wrapping posts.

13. The power strip according to claim 10, wherein the wire-passing gaps are arranged respectively corresponding to the jacks, and the jacks are arranged corresponding to the wrapping posts respectively.

14. The power strip according to claim 8, wherein the protective housing is in a shape of cylinder with the opening on one end thereof, the power strip body is in a shape of prismoid, and the jacks are distributed circumferentially on a sidewall of the power strip body, an annular space is formed between the sidewall of the power strip body and the inner wall of the protective housing for receiving the at least one plug.

15. The power strip according to claim 14, wherein the power strip body comprises a bottom wall connecting with a bottom circumference of the sidewall, an opening is defined in the bottom wall and a power jack is arranged at the opening of the bottom wall.

16. The power strip according to claim 8, wherein the protective housing is in a shape of cylinder with the opening on one end thereof, and the power strip body is attached to the inner wall of the protective housing, the power strip body defines a space at a central portion thereof for receiving the at least one plug.

17. The power strip according to claim 16, wherein a sidewall of the power strip body is in a shape of prismoid, and the jacks are distributed circumferentially on the sidewall of the power strip body, the power strip body further comprises a bottom flange extending radially outwardly from a bottom circumference of the sidewall to the inner wall of the protective housing.

18. The power strip according to claim 17, wherein the bottom flange defines an opening therein and a power jack is arranged at the opening of the bottom flange.

* * * * *